US012241353B2

(12) United States Patent
Oehring et al.

(10) Patent No.: US 12,241,353 B2
(45) **Date of Patent: *Mar. 4, 2025**

(54) SELF-REGULATING FRAC PUMP SUCTION STABILIZER/DAMPENER

(71) Applicant: U.S. Well Services, LLC, Houston, TX (US)

(72) Inventors: Jared Oehring, Houston, TX (US); Alexander Christinzio, Collegeville, PA (US); Lon Robinson, Houston, TX (US)

(73) Assignee: U.S. WELL SERVICES, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/983,187

(22) Filed: Nov. 8, 2022

(65) Prior Publication Data

US 2023/0212931 A1 Jul. 6, 2023

Related U.S. Application Data

(63) Continuation of application No. 17/136,913, filed on Dec. 29, 2020, now Pat. No. 11,492,886.
(Continued)

(51) Int. Cl.
*E21B 43/26* (2006.01)
*E21B 34/08* (2006.01)
(Continued)

(52) U.S. Cl.
CPC ..... *E21B 43/2607* (2020.05); *E21B 34/08* (2013.01); *E21B 34/142* (2020.05);
(Continued)

(58) Field of Classification Search
CPC ..... F04B 2205/03; F04B 39/0027; F04B 39/0038; F04B 19/06; F04B 15/02;
(Continued)

(56) References Cited

U.S. PATENT DOCUMENTS 1,541,601 A 6/1925 Tribe
1,743,771 A 1/1930 Hall et al.
(Continued)

FOREIGN PATENT DOCUMENTS

CN 104117308 A 10/2014
CN 104196613 A 12/2014
(Continued)

OTHER PUBLICATIONS

Notice of Allowance issued in corresponding U.S. Appl. No. 17/136,913, dated Jul. 6, 2022.
(Continued)

*Primary Examiner* — Kenneth L Thompson
(74) *Attorney, Agent, or Firm* — Abel Schillinger, LLP

(57) ABSTRACT

A hydraulic fracturing pump system includes an electric powered hydraulic fracturing pump positioned on a support structure. The system also includes a suction stabilizer/dampener coupled to a suction end of the pump. The system further includes a compressed gas supply, fluidly coupled to the suction stabilizer/dampener, and positioned on the support structure. The system also includes a flow path between the suction stabilizer/dampener and the compressed gas supply, the flow path including at least one valve and at least one regulator configured to control flow from the compressed gas supply to the suction stabilizer/dampener.

17 Claims, 6 Drawing Sheets

Related U.S. Application Data

(60) Provisional application No. 62/955,763, filed on Dec. 31, 2019.

(51) Int. Cl.
*E21B 34/14* (2006.01)
*F04B 11/00* (2006.01)
*F04B 17/03* (2006.01)
*E21B 11/00* (2006.01)

(52) U.S. Cl.
CPC ..... *F04B 17/03* (2013.01); *E21B 11/00* (2013.01); *E21B 43/2605* (2020.05)

(58) Field of Classification Search
CPC ..... F04B 11/0025; F04B 11/0016; F04B 11/0008; F04B 11/00; E21B 43/2605; E21B 43/2607
See application file for complete search history.

(56) References Cited

U.S. PATENT DOCUMENTS 1,967,466 A 7/1934 Damsel
2,237,812 A 4/1941 Blieux et al.
2,753,940 A 7/1956 Bonner
2,852,600 A 9/1958 Jenkins, Jr.
2,976,025 A 3/1961 Pro
3,116,086 A 12/1963 Barengoltz
3,347,570 A 10/1967 Roessler
3,794,846 A 2/1974 Schlicher et al.
3,878,884 A 4/1975 Raleigh
3,967,841 A 7/1976 Kendrick et al.
4,411,313 A 10/1983 Johnson et al.
4,442,665 A 4/1984 Fick et al.
4,538,916 A 9/1985 Zimmerman
4,562,360 A 12/1985 Fujimoto
4,601,629 A 7/1986 Zimmerman
4,768,884 A 9/1988 Elkin
4,783,038 A 11/1988 Gilbert et al.
4,898,473 A 2/1990 Stegemoeller et al.
5,114,239 A 5/1992 Allen
5,293,947 A 3/1994 Stratton
5,334,899 A 8/1994 Skybyk
5,439,066 A 8/1995 Gibson
5,486,047 A 1/1996 Zimmerman
5,549,285 A 8/1996 Collins
5,791,636 A 8/1998 Loziuk
5,798,596 A 8/1998 Lordo
5,813,455 A 9/1998 Pratt et al.
5,894,888 A 4/1999 Wiemers et al.
5,950,726 A 9/1999 Roberts
6,035,265 A 3/2000 Dister et al.
6,097,310 A 8/2000 Harrell et al.
6,116,040 A 9/2000 Stark
6,121,705 A 9/2000 Hoong
6,273,193 B1 8/2001 Hermann et al.
6,315,523 B1 11/2001 Mills
6,406,011 B1 6/2002 Kosar et al.
6,442,942 B1 9/2002 Kopko
6,510,695 B1 1/2003 Fisher
6,585,455 B1 7/2003 Petersen et al.
6,633,727 B2 10/2003 Henrie et al.
6,788,022 B2 9/2004 Sopko et al.
6,808,303 B2 10/2004 Fisher
6,837,910 B1 1/2005 Yoshikawa et al.
6,985,750 B1 1/2006 Vicknair et al.
7,279,655 B2 10/2007 Blutke et al.
7,309,835 B2 12/2007 Morrison et al.
7,341,287 B2 3/2008 Gibb et al.
7,494,263 B2 2/2009 Dykstra et al.
7,717,193 B2 5/2010 Egilsson et al.
7,770,396 B2 8/2010 Roby et al.
7,795,830 B2 9/2010 Johnson
7,807,048 B2 10/2010 Collette
7,845,413 B2 12/2010 Shampine et al.
7,900,893 B2 3/2011 Teurlay et al.
8,146,665 B2 4/2012 Neal
8,221,513 B2 7/2012 Ariyapadi et al.
8,272,439 B2 9/2012 Strickland
RE44,444 E 8/2013 Dole et al.
8,556,302 B2 10/2013 Dole
8,774,972 B2 7/2014 Rusnak et al.
8,789,601 B2 7/2014 Broussard et al.
8,893,787 B2 11/2014 Tips et al.
8,899,940 B2 * 12/2014 Leugemors ..... F04B 11/00 138/28
8,905,056 B2 12/2014 Kendrick
8,997,904 B2 4/2015 Cryer et al.
9,050,545 B1 * 6/2015 Seal ..... C22B 7/006
9,062,545 B2 6/2015 Roberts et al.
9,140,105 B2 9/2015 Pattillo
9,140,110 B2 9/2015 Coli et al.
9,353,593 B1 5/2016 Lu et al.
9,410,410 B2 8/2016 Broussard et al.
9,450,385 B2 9/2016 Kristensen
9,475,840 B2 10/2016 Lledóet al.
9,506,333 B2 11/2016 Castillo et al.
9,611,728 B2 4/2017 Oehring
9,790,858 B2 10/2017 Kanebako
9,893,500 B2 2/2018 Oehring et al.
9,903,190 B2 2/2018 Conrad et al.
9,945,365 B2 4/2018 Hernandez et al.
9,970,278 B2 5/2018 Broussard et al.
10,020,711 B2 7/2018 Oehring et al.
10,119,381 B2 11/2018 Oehring et al.
10,221,639 B2 3/2019 Romer et al.
10,254,732 B2 4/2019 Oehring et al.
10,280,724 B2 5/2019 Hinderliter
10,302,079 B2 5/2019 Kendrick
10,337,308 B2 7/2019 Broussard et al.
10,408,030 B2 9/2019 Oehring et al.
10,408,031 B2 9/2019 Oehring et al.
10,415,332 B2 9/2019 Morris et al.
10,422,327 B2 9/2019 Horwath et al.
10,526,882 B2 1/2020 Oehring et al.
10,591,101 B2 3/2020 Smith
10,648,270 B2 5/2020 Brunty et al.
10,648,311 B2 5/2020 Oehring et al.
10,686,301 B2 6/2020 Oehring et al.
10,690,131 B2 6/2020 Rashid et al.
10,731,561 B2 8/2020 Oehring et al.
10,740,730 B2 8/2020 Altamirano et al.
10,767,561 B2 9/2020 Brady
10,781,752 B2 9/2020 Kikkawa et al.
10,794,165 B2 10/2020 Fischer et al.
10,934,824 B2 3/2021 Oehring et al.
10,988,998 B2 4/2021 Fischer et al.
11,193,361 B1 12/2021 Yeung et al.
11,492,886 B2 * 11/2022 Oehring ..... F04B 23/04
11,686,328 B2 * 6/2023 Rogers ..... F15B 1/021 417/540
2001/0000996 A1 5/2001 Grimland et al.
2003/0057704 A1 3/2003 Baten et al.
2004/0045703 A1 3/2004 Hooper et al.
2004/0212679 A1 10/2004 Jun
2005/0116541 A1 6/2005 Seiver
2005/0201197 A1 9/2005 Duell et al.
2006/0109141 A1 5/2006 Huang et al.
2007/0125544 A1 6/2007 Robinson et al.
2007/0201305 A1 8/2007 Heilman et al.
2008/0142304 A1 6/2008 Schutz et al.
2008/0164023 A1 7/2008 Dykstra et al.
2008/0217024 A1 9/2008 Moore
2008/0236818 A1 10/2008 Dykstra
2008/0257449 A1 10/2008 Weinstein et al.
2008/0277120 A1 11/2008 Hickie
2009/0068031 A1 3/2009 Gambier et al.
2009/0072645 A1 3/2009 Quere
2009/0078410 A1 3/2009 Krenek et al.
2009/0114392 A1 5/2009 Tolman et al.
2009/0200290 A1 8/2009 Cardinal et al.
2009/0315297 A1 12/2009 Nadeau et al.
2010/0193057 A1 8/2010 Garner et al.

(56) References Cited

U.S. PATENT DOCUMENTS

| | | | |
|---|---|---|---|
| 2010/0281876 | A1 | 11/2010 | Khan et al. |
| 2011/0042387 | A1 | 2/2011 | Henry et al. |
| 2011/0061855 | A1 | 3/2011 | Case et al. |
| 2011/0063942 | A1 | 3/2011 | Hagan et al. |
| 2011/0081268 | A1 | 4/2011 | Ochoa et al. |
| 2011/0097988 | A1 | 4/2011 | Lord |
| 2011/0110793 | A1 | 5/2011 | Leugemores et al. |
| 2011/0175397 | A1 | 7/2011 | Amrine, Jr. et al. |
| 2011/0197988 | A1 | 8/2011 | Van Vliet et al. |
| 2011/0241590 | A1 | 10/2011 | Horikoshi et al. |
| 2012/0063936 | A1 | 3/2012 | Baxter et al. |
| 2012/0111560 | A1 | 5/2012 | Hill et al. |
| 2012/0112757 | A1 | 5/2012 | Vrankovic et al. |
| 2012/0150455 | A1 | 6/2012 | Franklin et al. |
| 2012/0255734 | A1 | 10/2012 | Coli et al. |
| 2013/0051971 | A1 | 2/2013 | Wyse et al. |
| 2013/0078114 | A1 | 3/2013 | Van Rijswick et al. |
| 2013/0138254 | A1 | 5/2013 | Seals et al. |
| 2013/0284455 | A1 | 10/2013 | Kajaria et al. |
| 2013/0306322 | A1 | 11/2013 | Sanborn et al. |
| 2014/0077607 | A1 | 3/2014 | Clarke et al. |
| 2014/0124162 | A1 | 5/2014 | Leavitt |
| 2014/0138079 | A1 | 5/2014 | Broussard et al. |
| 2014/0158345 | A1 | 6/2014 | Jang et al. |
| 2014/0174717 | A1 | 6/2014 | Broussard et al. |
| 2014/0251623 | A1 | 9/2014 | Lestz et al. |
| 2014/0273128 | A1 | 9/2014 | Coleman et al. |
| 2015/0038021 | A1 | 2/2015 | Gilliam |
| 2015/0114652 | A1 | 4/2015 | Lestz et al. |
| 2015/0144336 | A1 | 5/2015 | Hardin et al. |
| 2015/0147194 | A1 | 5/2015 | Foote |
| 2015/0233530 | A1 | 8/2015 | Sandidge |
| 2015/0252661 | A1 | 9/2015 | Glass |
| 2016/0006311 | A1 | 1/2016 | Li |
| 2016/0032703 | A1 | 2/2016 | Broussard et al. |
| 2016/0177678 | A1 | 6/2016 | Morris et al. |
| 2016/0230660 | A1 | 8/2016 | Zeitoun et al. |
| 2016/0258267 | A1 | 9/2016 | Payne et al. |
| 2016/0319649 | A1 | 11/2016 | Oehring |
| 2016/0326853 | A1 | 11/2016 | Fredd et al. |
| 2016/0348479 | A1 | 12/2016 | Oehring et al. |
| 2017/0082033 | A1 | 3/2017 | Wu et al. |
| 2017/0096889 | A1 | 4/2017 | Blanckaert et al. |
| 2017/0204852 | A1 | 7/2017 | Barnett, Jr. |
| 2017/0212535 | A1 | 7/2017 | Shelman et al. |
| 2017/0222409 | A1 | 8/2017 | Oehring et al. |
| 2017/0226842 | A1 | 8/2017 | Omont et al. |
| 2017/0370639 | A1 | 12/2017 | Bardon et al. |
| 2018/0090914 | A1 | 3/2018 | Johnson et al. |
| 2018/0181830 | A1 | 6/2018 | Luharuka et al. |
| 2018/0259080 | A1 | 9/2018 | Dale et al. |
| 2018/0266217 | A1 | 9/2018 | Funkhauser et al. |
| 2018/0284817 | A1 | 10/2018 | Cook et al. |
| 2018/0298731 | A1 | 10/2018 | Bishop |
| 2018/0312738 | A1 | 11/2018 | Rutsch et al. |
| 2018/0313677 | A1 | 11/2018 | Warren et al. |
| 2018/0363640 | A1 | 12/2018 | Kajita et al. |
| 2018/0366950 | A1 | 12/2018 | Pederson et al. |
| 2019/0010793 | A1 | 1/2019 | Hinderliter |
| 2019/0011066 | A1 | 1/2019 | Ungchusri et al. |
| 2019/0040727 | A1 | 2/2019 | Oehring et al. |
| 2019/0128104 | A1 | 5/2019 | Graham et al. |
| 2019/0145251 | A1 | 5/2019 | Johnson |
| 2019/0154020 | A1 | 5/2019 | Glass |
| 2019/0249527 | A1 | 8/2019 | Kraynek |
| 2019/0257462 | A1 | 8/2019 | Rogers |
| 2020/0040878 | A1 | 2/2020 | Morris |
| 2020/0232454 | A1 | 7/2020 | Chretien et al. |
| 2020/0325760 | A1 | 10/2020 | Markham |
| 2020/0350790 | A1 | 11/2020 | Luft et al. |
| 2021/0363979 | A1 | 11/2021 | Fox et al. |

FOREIGN PATENT DOCUMENTS

| | | | |
|---|---|---|---|
| CN | 112196508 | A | 1/2021 |
| WO | 0047893 | A1 | 8/2000 |
| WO | 2007055587 | A1 | 5/2007 |
| WO | 2009046280 | A1 | 4/2009 |
| WO | 2012051705 | A1 | 4/2012 |
| WO | 201411676 | A1 | 7/2014 |
| WO | 2014105642 | A1 | 7/2014 |
| WO | 2014177346 | A1 | 11/2014 |
| WO | 2018044307 | A1 | 3/2018 |
| WO | 2018213925 | A1 | 11/2018 |
| WO | 2019210417 | A1 | 11/2019 |

OTHER PUBLICATIONS

Non-Final Office Action issued in corresponding U.S. Appl. No. 16/404,283, dated Jul. 21, 2021.

Mistry et al., "Induction Motor Vibrations in View of the API 541-4th edition," IEEE, Paper No. PCIC-, 2008, 10 pages.

Paschall et al., "Navigating the Test Requirements of API 541 4th Edition," IEEE, Paper No. PCIC-2007-11, 2007, 12 pages.

"G7 Adjustable Speed Drive Operation Manual," Toshiba, Document No. 51546-009, Mar. 2005, 221 pages.

"Weir SPM: General Catalog," Weir SPM, 2009, 40 pages.

Krueger, "Advances in Well Completion and Stimulation During JPT's First Quarter Century," Journal of Petroleum Technology, Dec. 1973, p. 16.

Lietard et al., "Hydraulic Fracturing of Horizontal Wells: An Update of Design and Execution Guidelines," Society of Petroleum Engineers, SPE 37122, 1996, 15 pages.

Waters et al., "Simultaneous Hydraulic Fracturing of Adjacent Horizontal Wells in the Woodford Shale," Society of Petroleum Engineers, SPE 119635, 2009, 22 pages.

Bahadori et al., "Dictionary of Oil, Gas, and Petrochemical Processing," CRC Press, ISBN: 978-1-4665-8825-7, 2014, 8 pages.

"A Dictionary for the Oil and Gas Company—Second Edition," The University of Texas at Austin—Petroleum Extension Service, ISBN: 978-0-88698-240-9, 2011, 7 pages.

"Lessons Learned from Natural Gas STAR Partners: Reduced Emissions Completions for Hydraulically Fractured Natural Gas Wells," U.S. Environmental Protection Agency, 2011, 12 pages.

Kidnay et al., "Fundamentals of Natural Gas Processing—Second Edition," CRS Press, ISBN: 978-1-4200-8519-8, 2011, 19 pages (Part 1).

Kidnay et al., "Fundamentals of Natural Gas Processing—Second Edition," CRS Press, ISBN: 978-1-4200-8519-8, 2011, 17 pages (Part 2).

Kidnay et al., "Fundamentals of Natural Gas Processing—Second Edition," CRS Press, ISBN: 978-1-4200-8519-8, 2011, 12 pages (Part 3).

Listing at Amazon.com for Kidnay et al., "Fundamentals of Natural Gas Processing—Second Edition," CRS Press, ISBN: 978-1-4200-8519-8, Jul. 7, 2013, 4 pages.

Listing at Amazon.com for Kidnay et al., "Fundamentals of Natural Gas Processing—Second Edition," CRS Press, ISBN: 978-1-4200-8519-8, Feb. 22, 2015, 4 pages.

"Green Completions," IPIECA, Jan. 20, 2015, 7 pages.

"Sand Trap FAQ," Mountain Equipment of New Mexico, Inc., Jan. 8, 2014, 2 pages.

"Test Separators FAQ," Mountain Equipment of New Mexico, Inc., Jan. 8, 2014, 2 pages.

"Emergency Power Systems for Critical Facilities: A Best Practices Approach to Improving Reliability," Fema, Fema p. 1019. Sep. 2014, 170 pages.

Persily et al., "Indoor Environmental Issues in Disaster Resilience," NIST Technical Note 1882, Jul. 2015, 40 pages.

"Precision Heat and Control Systems for Onshore Drilling and Production," Chromalox Precision Heat and Control, 2011, 6 pages.

"ZEUS Electric Pumping Unit," Halliburton, printed 2021, 4 pages.

Nayyar, "Piping Handbook—Seventh Edition," Piping Handbook, 1999, 77 pages.

(56) References Cited

OTHER PUBLICATIONS

"Wire Rope Isolator Technologies," ITT Enidine, Inc., Mar. 29, 2014, Enidine, 78 pages.
Gardner Denver, Well Servicing Pump, Model GD-2500Q, GD-2500Q-HD, Quintuplex Pumps, Super GWS Fluid End (Uni-Flange) Parts List, 310FWF997 Revision A, Sep. 2011, 45 pages.
Wachel et al., "Analysis of Vibration and Failure Problems in Reciprocating Triplex Pumps for Oil Pipelines," The American Society of Mechanical Engineers, 1985, 8 pages.
"Flowline Products and Services—World Proven Chiksan and Weco Equipment," FMC Technologies, Mar. 28, 2015, 31 pages (Part 1).
"Flowline Products and Services—World Proven Chiksan and Weco Equipment," FMC Technologies, Mar. 28, 2015, 49 pages (Part 2).
"A complete line of swivel joints for drilling, production, and well servicing," Chiksan Original Swivel Joints, Nov. 1996, 16 pages.
"Worlds Best Swivel Joints," FlowValve, Jan. 17, 2015, available at https://web.archive.org/web/20150117041757/http://www.flowvalve.com/swivels, 10 pages.
"Victualic Couplings—Vibration Attenuation Characteristics," Victaulic Company, Oct. 2014, 5 pages.
Hudson et al., "Modeling Victaulic Couplings in Piping Stress Analysis Programs," Victaulic Company, WP-18 6685 Rev. B, Mar. 19, 2013, 19 pages.
"AGS Flexible Coupling Style W77," Victaulic, Apr. 23, 2015, available at: https://web.archive.org/web/20150423052817/http:/www.victaulic.com/en/products-services/products/style-w77-ags-flexible-coupling/, 1 page.
"Advanced Groove System (AGS) Large Diameter Solutions." Victaulic, Apr. 19, 2015, available at: https://web.archive.org/web/20150419063052/http:/www.victaulic.com/en/businesses-solutions/solutions/advanced-groove-system/, 2 pages.
"Accommodating Seismic Movement," Victaulic, Apr. 12, 2015, available at https://web.archive.org/web/20150412042941/http:/www.victaulic.com/en/businesses-solutions/solutions/accommodating-seismic-movement/, 2 pages.
Saville, "The Victaulic Pipe Joint," Journal (American Water Works Association), Nov. 1922, vol. 9, No. 6, 8 pages.
Balaji et al., "Wire rope isolators for vibration isolation of equipment and structures," IP Conference Series: Materials Science and Engineering, 2015, 12 pages.
"FlowGuard Products," CoorsTek, Sep. 15, 2014 available at: https://web.archive.org/web/20140915230538/ http://coorstek.com/resource-library/library/8510-1747-FlowGuard-Pulsation-Dampers.pdf, 8 pages.
"FlowGuard Pulsation Dampeners," CoorsTek, Feb. 23, 2015, available at: https://web.archive.org/web/20150223101630/http://www.coorstek.com/markets/energy_equipment/oil-gas/flowguard.php, 2 pages.
Morton, "Unlocking the Earth: A Short History of Hydraulic Fracturing," GEO ExPro, vol. 10, No. 6, Dec. 2013, 5 pages.
"Welcome to STAUFF," STAUFF, Aug. 5, 2013, 1 page.
"STAUFF Clamps," STAUFF, Aug. 7, 2013, 3 pages.
"STAUFF Clamps, Heavy Series (DIN 3015-2)," STAUFF, Aug. 30, 2013, 1 page.
"Heavy Series (DIN 3015-2)", STAUFF, Product Literature, Nov. 3, 2013, 1 page.
"Heavy Series DIN 3015, Part 2," STAUFF, Nov. 5, 2013, 24 pages.
Harris et al., "Harris' Shock and Vibration Handbook—Fifth Edition," McGraw-Hill Handbooks, 2002 [excerpted], 22 pages.
"Mark's Standard Handbook for Mechanical Engineers, 11th Edition," McGraw-Hill, ISBN 0-07-142867-4, 2007 [excerpted], 1 page.
Mallik et al., "On the Modelling of Non-Linear Elastomeric Vibration Isolators," Journal of Sound and Vibration, 1999, 219(2), 15 pages.
Malcius, "Mathematical model evaluation and parameter identification of pipe holder element," Journal of Vibroengineering, Jun. 2013, vol. 15, Issue 2, ISSN 1392-8716, 9 pages.
Wachel et al., "Piping Vibration Analysis," Engineering Dynamics, Incorporated, Proceedings of the Nineteenth Turbomachinery Symposium, 1990, 16 pages.
Canadian Office Action issued in Canadian Application No. 3,094,768 mailed Oct. 28, 2021.
Ton et al., "The U.S. Department of Energy's Microgrid Initiative," 25 The Electricity J. 84, 2012, pp. 84-94.
Non-Final Office Action issued in U.S. Appl. No. 16/901,774, mailed Sep. 14, 2021.
Kroposki et al., "Making Microgrids Work," 6 IEEE Power and Energy Mag. 40, 41, 2008.
Non-Final Office Action issued in U.S. Appl. No. 16/871,328, mailed Dec. 9, 2021.
Non-Final Office Action issued in U.S. Appl. No. 16/943,935, mailed Oct. 21, 2021.
Non-Final Office Action issued in U.S. Appl. No. 16/564,186, mailed Oct. 15, 2021.
Final Office Action issued in U.S. Appl. No. 16/356,263, mailed Oct. 7, 2021.
Non-Final Office Action issued in U.S. Appl. No. 17/060,647, mailed Sep. 20, 2021.
Woodbury et al., "Electric Design Considerations for Drilling Rigs," IEEE Transactions on Industry Applications, vol. 1A-12, No. 4, Jul./Aug. 1976, pp. 421-431.
Final Office Action issued in corresponding U.S. Appl. No. 16/404,283, dated Jan. 11, 2021.
Final Office Action issued in corresponding U.S. Appl. No. 16/597,014, dated Feb. 4, 2021.
International Search Report and Written Opinion issued in PCT Application No. PCT/US2020/053980, dated Dec. 14, 2020.
Non-Final Office Action issued in corresponding U.S. Appl. No. 14/881,525, dated Jul. 21, 2021.
Morris et al., U.S. Appl. No. 62/526,869; Hydration-Blender Transport and Electric Power Distribution for Fracturing Operation; Jun. 28, 2018; USPTO; see entire document.
International Search Report and Written Opinion issued in PCT Application No. PCT/US2020/067608, dated Mar. 30, 2021.
International Search Report and Written Opinion issued in PCT Application No. PCT/US2020/067528, dated Mar. 19, 2021.
International Search Report and Written Opinion issued in PCT Application No. PCT/US2020/067526, dated May 6, 2021.
International Search Report and Written Opinion issued in PCT Application No. PCT/US2020/067523, dated Mar. 22, 2021.
International Search Report and Written Opinion issued in PCT Application No. PCT/US2020/067146, dated Mar. 29, 2021.
International Search Report and Written Opinion issued in PCT Application No. PCT/US2020/066543, dated May 11, 2021.
International Search Report and Written Opinion issued in PCT Application No. PCT/US2020/059834, dated Feb. 4, 2021.
International Search Report and Written Opinion issued in PCT Application No. PCT/US2020/058899, dated Feb. 3, 2021.
International Search Report and Written Opinion issued in PCT Application No. PCT/US2020/058906, dated Feb. 2, 2021.
Non-Final Office Action issued in corresponding U.S. Appl. No. 16/522,043, dated Jan. 4, 2021.
Non-Final Office Action issued in corresponding U.S. Appl. No. 16/564,185, dated Jan. 29, 2021.
Non-Final Office Action issued in corresponding U.S. Appl. No. 16/871,928, dated Aug. 25, 2021.
Non-Final Office Action issued in corresponding U.S. Appl. No. 16/943,727, dated Aug. 3, 2021.
Notice of Allowance issued in corresponding U.S. Appl. No. 15/829,419, dated Jul. 26, 2021.
Arvani et al., "Design and Development of an Engineering Drilling Simulator and Application for Offshore Drilling for MODUs and Deepwater Environments," Society of Petroleum Engineers, SPE-170301-MS, 2014, 17 pages.
Davis, "Natural Gas Finding Niche in E-Fracking, But Diesel Still Rules," Natural Gas Intelligence, NGI, 2019, 9 pages.
Shafto, "Growth in electric-fracking fleets stunted by tight producer budgets," S&P Global Market Intelligence, Aug. 6, 2019, 4 pages.
"Swivel Joint," Jereh, Yantal Jereh Petroleum Equipment & Technologies Co. Ltd., printed Dec. 1, 2022, 14 pages.

(56) References Cited

OTHER PUBLICATIONS

Camara, "Electrical Engineering Reference Manual for the Electrical and Computer PE Exam—Sixth Edition," Professional Publications, Inc., ISBN: 1-888577-56-8, 2002, 50 pages.
"Comprehensive Power, Power It Up," Technical Presentation, Feb. 27, 2013 (available at: https://www.slideshare.net/jeffsable/comprehensive-power-introduction-oct2013?from_action=save), 28 pages.
"Comprehensive Power, Power It Up," Technical Presentation, Oct. 3, 2013 (available at: https://www.slideshare.net/jeffsable/comprehensive-power-introduction-oct2013?from_action=save), 26 pages.
"American National Standard—Motors and Generators," ANSI/NEMA MG 1, 2011, 636 pages.
"IEEE Standard for Petroleum and Chemical Industry—Premium-Efficiency, Severe-Duty, Totally Enclosed Fan-Cooled (TEFC) Squirrel Cage Induction Motors—Up to and Including 370 KW (500 hp)," IEEE, 2009, 32 pages.
Cary et al., "Electric Rotating Machine Standards Part II: Magnetic Wedge Design & Monitoring Methods," IEEE, Paper No. PCIC-2011-41, 2011, 8 pages.
Bogh et al., "A User's Guide to Factory Testing of Large Motors: What Should Your Witness Expect?," IEEE, Paper No. PCIC-, 2009, 8 pages.
Lockley et al., "What Do the API Motor/Generator Features Cost and What Do They Buy You?," IEEE, Paper No. PCIC-2010-22, 2010, 10 pages.
Malinowski et al., "Petrochemical standards a comparison between IEEE 841-2001, API 541 and API 547," IEEE, Paper No. PCIC-2004-22, 2004, 8 pages.
"Reinventing the Frac Fleet," Clean Fleet, WhisperFrac Reducing Noise and Vibrations, 2018, 2 pages.
"MEC's Mobile Electric Centers for Voltages up to 36kV," ABB, printed 2021, 2 pages.
"Prefabricated Electric Centers (PEC)—Mobile Electric Centers (MEC)," ABB, 2017, 14 pages.
"Mobile Substations on wheels," ABB, 2022, 4 pages.
"Benefits of Using Mobile Transformers and Mobile Substations for Rapidly Restoring Electrical Service," U.S. Department of Energy, Aug. 2006, 48 pages.
"The Evolution of the Modern Substation," Primera, 2022, 4 pages.
Hanna et al., "Medium-Voltage Adjustable-Speed Drives—Users' and Manufacturers' Experiences," IEEE Transactions on Industry Applications, vol. 33, No. 6, Nov./Dec. 1997, 9 pages.
"IEEE 100: The Authoritative Dictionary of IEEE Standards Terms, Seventh Edition," IEEE Press, 2000, ISBN: 0-7381-2601-2, 7 pages.
"Adjustable Speed Electrical Power Drive Systems—Part 4: General Requirements—Rating Specifications for A.C. Power Drive Systems Above 1000 V A.C. and Not Exceeding 35 KV," National Electrical Manufacturers Association (NEMA) Standards Publication ICS 61800-4, 2004, 139 pages.
Roe, "Practices and Procedures of Industrial Electrical Design," McGraw-Hill, 1972, ISBN: 0-07-053390-3, 17 pages.
Oehring et al., U.S. Appl. No. 62/242,173, 2015, 17 pages.
Samsung All-In-One Security System, Quick Start Guide Kit Model SDHC5100, printed 2022, 11 pages.
Amazon.com listing for Samsung SDH-C5100 16 Channel 720p HD DVR Video Security System, 2015, 2 pages.
Amazon.com listing for Amcrest ProHD Wireless IP Security Camera, 2015, 8 pages.
Amazon.com listing for Security & Surveillance Cameras, 2015, 6 pages.
Stewart, "Extracting the Digit! Time for an ROV Electronics Shake-Up?," Kongsberg Simrad Ltd, UTI, 1997, 10 pages.
Martin et al., "Lessons Learned from 27 Years' Experience of Stimulation Vessel Design and Operation—a Case Study," SPE 166243, 2013, 12 pages.
Maddox, "Visualizing Production in Flowing Oil Wells," Halliburton Energy Services, SPWLA 37th Annual Logging Symposium, Jun. 16-19, 1996, 6 pages.
Cooper et al., "The First Purpose-Built Stimulation Vessel for North Sea Application," Dowell Schlumberger, Society of Petroleum Engineers of AIME, SPE 12993, 1984, 7 pages.
Talley, "Development of a Closed Circuit TV Borehole Probe," Design Engineering Laboratories, Inc., Contract H0308041, Sep. 1984, 22 pages.
Smith et al., "Fracture Width-Design vs. Measurement," Amoco Production Co., Society of Petroleum Engineers of AIME, SPE 10965, 1982, 9 pages.
Hurst et al., "Development and Application of 'Frac' Treatments in the Permian Basin," SPE 405-G, vol. 204, 1955, 8 pages.
Briggs, "Development of a Downhole Television Camera," Oceanographic Engineering Corporation, 1964, 1 page.
IPIECA About Us page, 2015, 1 page.
Appl et al., "A Viewing Lens for High Pressure Applications," Society of Petroleum Engineers of AIME, SPE-299, 1962, 7 pages.
Taylor, "Efficiency: Watchword of the Oil Industry," Financial Analysts Journal, 2018, 4 pages.
Pritchard, "U.S. Color Television Fundamentals: A Review," SMPTE Journal, Nov. 1977, vol. 86, 10 pages.
Moxastore website, listing for NPORTIA5250, 2015, 2 pages.
Moxastore website, About UsS, 2015, 1 page.
Moxastore website, Homepage, 2015, 2 pages.
Moxastore website, listing for Moxa 802.11 Ethernet to Serial, 2016, 1 page.
Amazon.com listing for Global Cache iTach, IP to Serial with PoE (IP2SL-P) by Global Cach, 2014, 3 pages.
Amazon.com listing for SainSmart TCP/IP Ethernet to Serial RS232 RS485 Intelligent Communication Converter by SainSmart, 2014, 4 pages.
Amazon.com listing for TCP/IP Ethernet to Serial RS232 RS485 RS422 Converter by Atc, 2014, 2 pages.
Amazon.com listing for StarTech.com 1 Port RS232 Serial to IP Ethernet Converter (NETRS2321P) by StarTech, 2014, 4 pages.
Amazon.com listing for StarTech NETRS2321E 1 Port RS-232/422/485 Serial over IP Ethernet Device Server by StarTech, 2014, 4 pages.
OSHA-NIOSH Hazard Alert: Worker Exposure to Silica during Hydraulic Fracturing, U.S. Department of Labor, 2012, 15 pages.
Avallone et al., "Marks Standard Handbook for Mechanical Engineers 11th Edition," McGraw-Hill, 2007, 5 pages.
Fink, "Standard Handbook for Electrical Engineers," Thirteenth Edition, McGraw-Hill, ISBN: 0-07-020984-7, 7 pages (excerpts) (Part 1).
Fink, "Standard Handbook for Electrical Engineers," Thirteenth Edition, McGraw-Hill, ISBN: 0-07-020984-7, 7 pages (excerpts) (Part 2).
Fink, "Standard Handbook for Electrical Engineers," Thirteenth Edition, McGraw-Hill, ISBN: 0-07-020984-7, 6 pages (excerpts) (Part 3).
Roe, "Practices and Procedures of Industrial Electrical Design," McGraw-Hill, 1972, ISBN: 0-07-053390-3, 14 pages (Part 1).
Roe, "Practices and Procedures of Industrial Electrical Design," McGraw-Hill, 1972, ISBN: 0-07-053390-3, 11 pages (Part 2).
Camara, "Electrical Engineering Reference Manual for the Electrical and Computer PE Exam—Sixth Edition," Professional Publications, Inc., ISBN: 1-888577-56-8, 2002, 17 pages (Part 1).
Camara, "Electrical Engineering Reference Manual for the Electrical and Computer PE Exam—Sixth Edition," Professional Publications, Inc., ISBN: 1-888577-56-8, 2002, 25 pages (Part 2).
Camara, "Electrical Engineering Reference Manual for the Electrical and Computer PE Exam—Sixth Edition," Professional Publications, Inc., ISBN: 1-888577-56-8, 2002, 20 pages (Part 3).
Camara, "Electrical Engineering Reference Manual for the Electrical and Computer PE Exam—Sixth Edition," Professional Publications, Inc., ISBN: 1-888577-56-8, 2002, 19 pages (Part 4).
Camara, "Electrical Engineering Reference Manual for the Electrical and Computer PE Exam—Sixth Edition," Professional Publications, Inc., ISBN: 1-888577-56-8, 2002, 21 pages (Part 5).

(56) References Cited

OTHER PUBLICATIONS

PPI Course Catalog, 2004, available at: https://web.archive.org/web/20040220012405/http://ppi2pass.com/catalog/servlet/MyPpi_fl_corner-catalog.pdf, 16 pages.
"Teaching an Electrical and Computer Engineering PE Exam Review Course," PPI, 2003, available at: https://web.archive.org/web/20031223100101/http://ppi2pass.com/catalog/servlet/MyPpi_pg_corner-teachee.html, 2 pages.
"Instructors Corner," PPI, 2003, available at: https://web.archive.org/web/20031219232547/http://ppi2pass.com/catalog/servlet/MyPpi_pg_corner-corner.html, 2 pages.
EE-Reference Online Index, 2004, available at: https://web.archive.org/web/20040731020344/http://ppi2pass.com/catalog/servlet/MyPpi_fl_indices-EERMindex.pdf, 41 pages.
EE-Reference Online Introduction, 2004, available at: https://web.archive.org/web/20041013101643/http://ppi2pass.com/catalog/servlet/MyPpi_fl_indices-EERMIntro.pdf, 12 pages.
"Electrical PE Exam Review Products," PPI Online Catalog, 2004, available at: https://web.archive.org/web/20040214233851/http://ppi2pass.com/catalog/servlet/MyPpi_ct_ELECTRICAL, 7 pages.
"The PPI Online Catalog," 2004, available at: https://web.archive.org/web/20040215142016/http://ppi2pass.com/catalog/servlet/MyPpi_ct_MAIN, 2 pages.
Homepage of Professional Publications, Inc., 2004, available at: https://web.archive.org/web/20040209054901/http:/ppi2pass.com/catalog/servlet/MyPpi, 1 page.
"What PPI Customers Say," 2003), available at: https://web.archive.org/web/20031226130924/http://ppi2pass.com/catalog/servlet/MyPpi_pg_comments-EEcomments.html, 2 pages.
"About PPI," 2003, available at: https://web.archive.org/web/20031219231426/http://ppi2pass.com:80/catalog/servlet/MyPpi_pg_aboutppi.html, 1 page.
Amazon.com listing of EE-Reference, 2007, available at: https://web.archive.org/web/20070103124447/https://www.amazon.com/Electrical-Engineering-Reference-Manual-Computer/dp/1888577568/, 7 pages.
Hampton, "Low-cost fracking offers boon to oil producers, headaches for suppliers," Reuters, Sep. 12, 2019, https://www.reuters.com/article/us-usa-oil-electric-fracturing-focus/low-cost-fracking-offers-boon-to-oil-producers-headaches-for-supplies, 11 page.
"All Electric Fracturing—Reducing Emissions and Cost," 2021, H013770, 6 pages.
Abbott et al., "Crippling the Innovation Economy: Regulatory Overreach at the Patent Office," Regulatory Transparency Project of the Federalist Society, Aug. 14, 2017, 35 pages.
"Hydraulic Fracturing Techbook," HARTENERGY, 2015, 9 pages.
"Petroleum Alumnus and Team Development Mobile Fracturing Unit that Alleviates Environmental Impact," LSU College of Engineering, 2021, 2 pages.
"Clean Fleet Reduces Emissions by 99% at Hydraulic Fracturing Sites," FluidPower Journal, 2019, 5 pages.
Deuster, "Game-changing hydraulic fracturing technology, reduces emissions by 99%," Intrado GlobeNewswire, Oct. 1, 2014, 4 pages.
"Halliburton Delivers Successful Grid-Powered Frac Operation", Halliburton News Release, Jan. 14, 2021, 4 pages.
Wang et al., "Development in the Limited—Entry Completion Fracturing Technique," SPE 17834, 1988, 13 pages.
Holden III et al., "Successful Stimulation of Fordoche Field With a Retarded HF Acid," Society of Petroleum Engineers of AIME, Aug. 1981, 6 pages.
Milligan, "Sour Gas Well Completion Practices in the Foothills," Society of Petroleum Engineers of AIME, Sep. 1982, 12 pages.
Beck et al., "Reservoir Evaluation of Fractured Cretaceous Carbonates in South Texas," SPWLA Eighteenth Annual Logging Symposium, Jun. 5-8, 1977, 25 pages.
Webster, "Current Completion Practices in Tight Reservoirs," Society of Petroleum Engineers, SPE 6379, 1977, 8 pages.
Bielstein, "Wire-Line Methods and Equipment," Humble Oil and Refining Company, Apr. 2, 1967, 16 pages.
"Form-wound Squirrel-Cage Induction Motors—500 Horsepower and Larger," ANSI/API Standard, 541-2003, Fourth Edition, Jun. 2004, 88 pages.
Gardner Denver, "Well Servicing Pump, Model GD-2500Q, Quintuplex, Operating and Service Manual," 300FWF996 Revision C, Aug. 2005, 46 pages.
"Standard Specification for Steel Bars, Carbon and Alloy, Hot-Wrought, General Requirements for," ASTM Int;I, A 29/A 29M—05, 2005, 16 pages.
"Variable Speed Pumping: A Guide to Successful Applications," Elsevier 2004, ISBN 1-85617-449-2, 2004, 186 pages.
Bonnett et al., "Squirrel Cage Rotor Options for A.C. Induction Motors," IEEE, 2000, 14 pages.
Bonnett, "Root Cause Failure Analysis for AC Induction Motors in the Petroleum and Chemical Industry," IEEE, Paper No. PCIC-2010-43, 2010, 13 pages.
"Mark's Standard Handbook for Mechanical Engineers, 11th Edition," McGraw-Hill, ISBN 0-07-142867-4, 2006, 11 pages.
"Standard Handbook for Electrical Engineers," Thirteenth Edition, McGraw-Hill, ISBN 0-07-020984-7, 1993, 9 pages (Part 1).
"Standard Handbook for Electrical Engineers," Thirteenth Edition, McGraw-Hill, ISBN 0-07-020984-7, 1993, 7 pages (Part 2).
"Standard Handbook for Electrical Engineers," Thirteenth Edition, McGraw-Hill, ISBN 0-07-020984-7, 1993, 6 pages (Part 3).
"112 IEEE Standard Test Procedure for Polyphase Induction Motors and Generators," IEEE Power Engineering Society, IEEE Std 112, 2004, 42 pages (Part 1).
"112 IEEE Standard Test Procedure for Polyphase Induction Motors and Generators," IEEE Power Engineering Society, IEEE Std 112, 2004, 45 pages (Part 2).
Hodowanec et al., "Introduction to API Standard 541, 4th Edition—Form-Wound Squirrel Cage Induction Motors—Larger than 500 Horsepower," IEEE, Paper No. PCIC-2003-33, 2003, 9 pages.
Rahill et al., "Sorting Out the Overlap," IEEE Industry Applications Magazine, vol. 15, No. 1, Jan.-Feb. 2009, 12 pages.
"Manufacturers of Cushioned Clamping, Quick Coupling & Support Systems," ZSI Beta Clamps, ZSI, Inc., Apr. 29, 2015, 2 pages.
Meikrantz et al., "Advances in Liquid/Liquid Centrifuge Design Provide New Options for Petroleum Production," Society of Petroleum Engineers, SPE 56709, 1999, 4 pages.

* cited by examiner

SELF-REGULATING FRAC PUMP SUCTION STABILIZER/DAMPENER

CROSS REFERENCE TO RELATED APPLICATIONS

This application is a continuation of U.S. patent application Ser. No. 17/136,913 filed Dec. 29, 2020 titled "SELF-REGULATING FRAC PUMP SUCTION STABILIZER/DAMPENER," which is now U.S. Pat. No. 11,492,886 issued on Nov. 8, 2022, which claims priority to and the benefit of U.S. Provisional Application Ser. No. 62/955,763 filed Dec. 31, 2019 titled "SELF-REGULATING FRAC PUMP SUCTION STABILIZER/DAMPENER," the full disclosures of which are hereby incorporated herein by reference in their entirety for all intents and purposes.

BACKGROUND

1. Technical Field

This disclosure relates generally to hydraulic fracturing and more particularly to systems and methods for regulating pumping operations.

2. Background

With advancements in technology over the past few decades, the ability to reach unconventional sources of hydrocarbons has tremendously increased. Horizontal drilling and hydraulic fracturing are two such ways that new developments in technology have led to hydrocarbon production from previously unreachable shale formations. Hydraulic fracturing (fracturing) operations typically require powering numerous components in order to recover oil and gas resources from the ground. For example, hydraulic fracturing usually includes pumps that inject fracturing fluid down the wellbore, blenders that mix proppant into the fluid, cranes, wireline units, and many other components that all must perform different functions to carry out fracturing operations.

Usually in fracturing systems the fracturing equipment runs on diesel-generated mechanical power or by other internal combustion engines. Such engines may be very powerful, but have certain disadvantages. Diesel is more expensive, is less environmentally friendly, less safe, and heavier to transport than natural gas. For example, heavy diesel engines may require the use of a large amount of heavy equipment, including trailers and trucks, to transport the engines to and from a wellsite. In addition, such engines are not clean, generating large amounts of exhaust and pollutants that may cause environmental hazards, and are extremely loud, among other problems. Onsite refueling, especially during operations, presents increased risks of fuel leaks, fires, and other accidents. The large amounts of diesel fuel needed to power traditional fracturing operations requires constant transportation and delivery by diesel tankers onto the well site, resulting in significant carbon dioxide emissions.

Some systems have tried to eliminate partial reliance on diesel by creating bi-fuel systems. These systems blend natural gas and diesel, but have not been very successful. It is thus desirable that a natural gas powered fracturing system be used in order to improve safety, save costs, and provide benefits to the environment over diesel powered systems. Turbine use is well known as a power source, but is not typically employed for powering fracturing operations.

Though less expensive to operate, safer, and more environmentally friendly, turbine generators come with their own limitations and difficulties as well. As is well known, turbines generally operate more efficiently at higher loads. Many power plants or industrial plants steadily operate turbines at 98% to 99% of their maximum potential to achieve the greatest efficiency and maintain this level of use without significant difficulty. This is due in part to these plants having a steady power demand that either does not fluctuate (i.e., constant power demand), or having sufficient warning if a load will change (e.g., when shutting down or starting up a factory process).

Space is at a premium at a fracturing site, where different vendors are often working simultaneously to prepare for a fracturing operation. As a result, utilizing systems that have large footprints may be undesirable. However, pressure pumpers still need to be able to provide sufficient pumping capacity in order to complete fracturing jobs.

During operations, a slurry solution is directed toward a fracturing pump, such as a positive displacement pump, and is charged in order to reduce fluid pulsations and pressure fluctuations. Often, a charging unit is provided, which has a separate set of maintenance and operation steps. As a result, additional time is lost at the site, along with an increased footprint and complicated set up.

SUMMARY

Applicant recognized the problems noted above herein and conceived and developed embodiments of systems and methods, according to the present disclosure, for pump control operations.

In an embodiment, a complete self-regulating system includes plumbing air (or other substance) lines, regulators, and valves on a frac pump (or other locations within the system) in order to utilize an existing air supply located within the tractor that the pump trailers are connected to. Additionally, in embodiments, a centralized source could be deployed on location and tied into this self-regulating system. This would serve as new configuration and set up creating an improvement to the system. It also is an improvement to the process of maintaining these units, eliminating the need to manually transport a supply to each individual unit.

In an embodiment, plumbing is provided from a supply source from the tractor or centralized source. Also, embodiments include regulators and valves so that the dampener can be re-charged without the need of hooking up a supply source each time a unit needs re-filled. Gauges are also installed so a visual can be seen on what the current charge pressure is. Other sensors, probes, meters, monitors could be utilized along with some intelligent local or remote algorithm that would further self-regulate pressure without the need of human interaction In an embodiment, air lines from the tractor's trailer air tank feeding into a ball valve and then an air pressure regulator. From there, additional air lines feed into the inlet of the suction dampener/stabilizer. The regulator is manual at this time and depends on a human to set pressure and open the ball valve. However, embodiments may incorporate sensors detecting pressure and automated valves and regulators that could recharge the system when low-pressure limits are reached, as well as bleed off pressure if a high pressure limit were to be reached. Embodiments may also include replacement of individual pump suction dampeners/stabilizers with one single unit placed prior to the pumps. This could be on the suction side of the blender, the discharge side of the blender, on the supply missile or another location within the system. Additionally, multiple units that serve two or more pumps may be deployed.

In an embodiment, a hydraulic fracturing pump system includes an electric powered hydraulic fracturing pump, a suction stabilizer/dampener coupled to a suction end of the pump, a compressed gas supply, fluidly coupled to the suction stabilizer/dampener, and a control system (e.g., dampener control system) positioned along a flow path between the suction stabilizer/dampener and the compressed gas supply. The control system includes a valve, a regulator, and a sensor. The system may also include an electronic control system, which may include an electronics package to operate the pump, gas supply, etc. Accordingly, it should be appreciated that the pump system may be formed form individual subsystems that may cooperate to enable operations of the pump system.

In an embodiment, a method for controlling a pumping operation includes charging a suction stabilizer/dampener via a compressed gas supply. The method also includes determining a charge pressure of the suction stabilizer/dampener is within a threshold of a target pressure. The method further includes setting a pressure control device, along a flow path between the suction stabilizer/dampener and the compressed gas supply. The method also includes operating a hydraulic fracturing pump coupled to the suction stabilizer/dampener.

In an embodiment, a hydraulic fracturing pump system includes an electric powered hydraulic fracturing pump positioned on a support structure. The system also includes a suction stabilizer/dampener coupled to a suction end of the pump. The system further includes a compressed gas supply, fluidly coupled to the suction stabilizer/dampener, and positioned on the support structure. The system also includes a flow path between the suction stabilizer/dampener and the compressed gas supply, the flow path including at least one valve and at least one regulator configured to control flow from the compressed gas supply to the suction stabilizer/dampener.

BRIEF DESCRIPTION OF DRAWINGS

Some of the features and benefits of the present disclosure having been stated, others will become apparent as the description proceeds when taken in conjunction with the accompanying drawings, in which.

Figure 1:
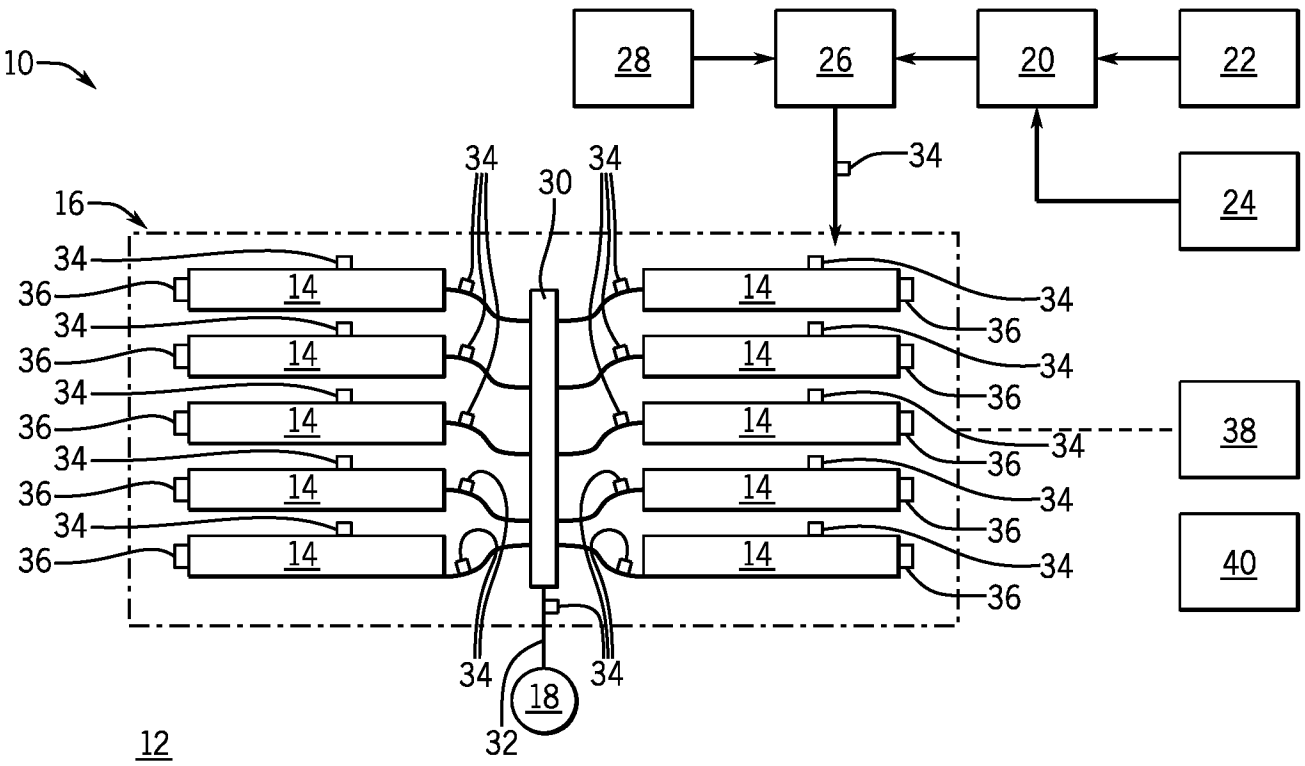
FIG. 1 is a schematic plan view of an embodiment of a fracturing operation, in accordance with embodiments of the present disclosure.

While the disclosure will be described in connection with the preferred embodiments, it will be understood that it is not intended to limit the disclosure to that embodiment. On the contrary, it is intended to cover all alternatives, modifications, and equivalents, as may be included within the spirit and scope of the disclosure as defined by the appended claims.

DETAILED DESCRIPTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions. Additionally, recitations of steps of a method should be understood as being capable of being performed in any order unless specifically stated otherwise. Furthermore, the steps may be performed in series or in parallel unless specifically stated otherwise.

Current systems, in order to maintain proper charge, use an air tank or nitrogen bottle brought to each individual pump truck. This tank or bottle is hooked up to the dampener and used to fill or charge the system. This current process is time consuming and involves multiple steps in the process. Embodiments of the present disclosure overcome these challenges by enabling an operator (or automatic actuator) to open a valve and adjust a regulator to allow the system to be filled/charged. Using a regulator, a set pressure may be dialed in (e.g., set) prior to opening the valve so that the system is charged to a desire pressure. Current methods rely on operators (e.g., human operators) to fill the dampener and stop filling periodically in order to place a pressure gauge to check that status of the fill/charge. This process may be time consuming and inefficient, and moreover, may position an operator in close contact with equipment. Embodiments of the present disclosure over this problem and further reduce the need to transport and connect a supply source to each individual unit.

Embodiments of the present disclosure provide a self-regulating stabilizer/dampener that utilizes a ready source of gas (e.g., air) during pumping operations. As noted, during pumping, the suction stabilizer/dampener may be utilized to smooth or reduce fluid pulsations and pressure fluctuations. The suction stabilizer/dampener is charged (e.g., pressurized) using a gas, which may be provided using a vessel or tank. The compressed gas acts as a diaphragm or bladder to energize the system. Maintenance operations may be time consuming, and as a result, embodiments of the present disclosure simplify the process by providing a plumbing configuration, which couples an available supply source, such as from a nearby trailer, to the stabilizer/dampener and includes a regulator within the line. As a result, pressure provided to the stabilizer/dampener may be controlled, thereby reducing operator involvement. Moreover, embodiments may include an automated system when the regulator and an associated valve are both automatically controlled, thereby providing a configuration where an operator may not be involved with pressurizing the stabilizer/dampener.

FIG. 1 is a plan schematic view of an embodiment of a hydraulic fracturing system 10 positioned at a well site 12. In the illustrated embodiment, pumping units 14 (e.g., pump trucks), which make up a pumping system 16, are used to pressurize a slurry solution for injection into a wellhead 18. An optional hydration unit 20 receives fluid from a fluid source 22 via a line, such as a tubular, and also receives additives from an additive source 24. In an embodiment, the fluid is water and the additives are mixed together and transferred to a blender unit 26 where proppant from a proppant source 28 may be added to form the slurry solution (e.g., fracturing slurry) which is transferred to the pumping system 16. The pumping units 14 may receive the slurry solution at a first pressure (e.g., 80 psi to 160 psi) and boost the pressure to around 15,000 psi for injection into the wellhead 18. In certain embodiments, the pumping units 14 are powered by electric motors.

After being discharged from the pump system 16, a distribution system 30, such as a missile, receives the slurry solution for injection into the wellhead 18. The distribution system 30 consolidates the slurry solution from each of the pump trucks 14 and includes discharge piping 32 coupled to the wellhead 18. In this manner, pressurized solution for hydraulic fracturing may be injected into the wellhead 18.

In the illustrated embodiment, one or more sensors 34, 36 are arranged throughout the hydraulic fracturing system 10 to measure various properties related to fluid flow, vibration, and the like. In embodiments, the sensors 34, 36 transmit flow data to a data van 38 for collection and analysis, among other things. Furthermore, while not pictured in FIG. 1, there may be various valves distributed across the system. For examples, a manifold (not pictured) may be utilized to supply fluid to the pumping units 14 and/or to receive the pressurized fluid from the pumping units 14. Valves may be distributed to enable isolation of one or more components. As an example, there may be valves arranged to enable isolation of individual pumping units 14. Furthermore, various support units may also include valves to enable isolation. As noted above, it may be desirable to isolate singular pumping units 14 or the like if operation upsets are detected. This would enable operations to continue, although at a lower rate, and may potential environmental or personnel hazards, as well as prevent increased damage to the components. However, during operations, personnel may be evacuated or otherwise restricted from entering a pressure zone. Embodiments of the present disclosure may enable remote operation of the valves and, in various embodiments, may enable electrical control using electric energy provided on site, such as through a generator or the like.

A power generation system 40 is shown, which may include turbines, generators, switchgears, transformers, and the like. In various embodiments, the power generation system 40 provides energy for one or more operations at the well site. It should be appreciated that while various embodiments of the present disclosure may describe electric motors powering the pumping units 14, in embodiments, electrical generation can be supplied by various different options, as well as hybrid options. Hybrid options may include two or more of the following electric generation options: Gas turbine generators with fuel supplied by field gas, compressed natural gas (CNG), and/or liquefied natural gas (LNG), diesel turbine generators, diesel engine generators, natural gas engine generators, batteries, electrical grids, and the like. Moreover, these electric sources may include a single source type unit or multiple units. For example, there may be one gas turbine generator, two gas turbines generators, two gas turbine generators coupled with one diesel engine generator, and various other configurations.

In various embodiments, equipment at the well site may utilize 3 phase, 60 Hz, 690V electrical power. However, it should be appreciated that in other embodiments different power specifications may be utilized, such as 4160V or at different frequencies, such as 50 Hz. Accordingly, discussions herein with a particular type of power specification should not be interpreted as limited only to the particularly discussed specification unless otherwise explicitly stated. Furthermore, systems described herein are designed for use in outdoor, oilfield conditions with fluctuations in temperature and weather, such as intense sunlight, wind, rain, snow, dust, and the like. In embodiments, the components are designed in accordance with various industry standards, such as NEMA, ANSI, and NFPA.

As noted, suction stabilizers/dampeners are used to stabilize the fluid that is supplying the positive displacement plunger pumps used in fracturing operations. By maintaining a set charge to the dampener, the dampener may function efficiently, which provides advantages to the pumping process, such as reduced cavitation, prolonged fluid end life, and reduced jerking of the suction hose, which may reduce exterior wear.

Figure 2:
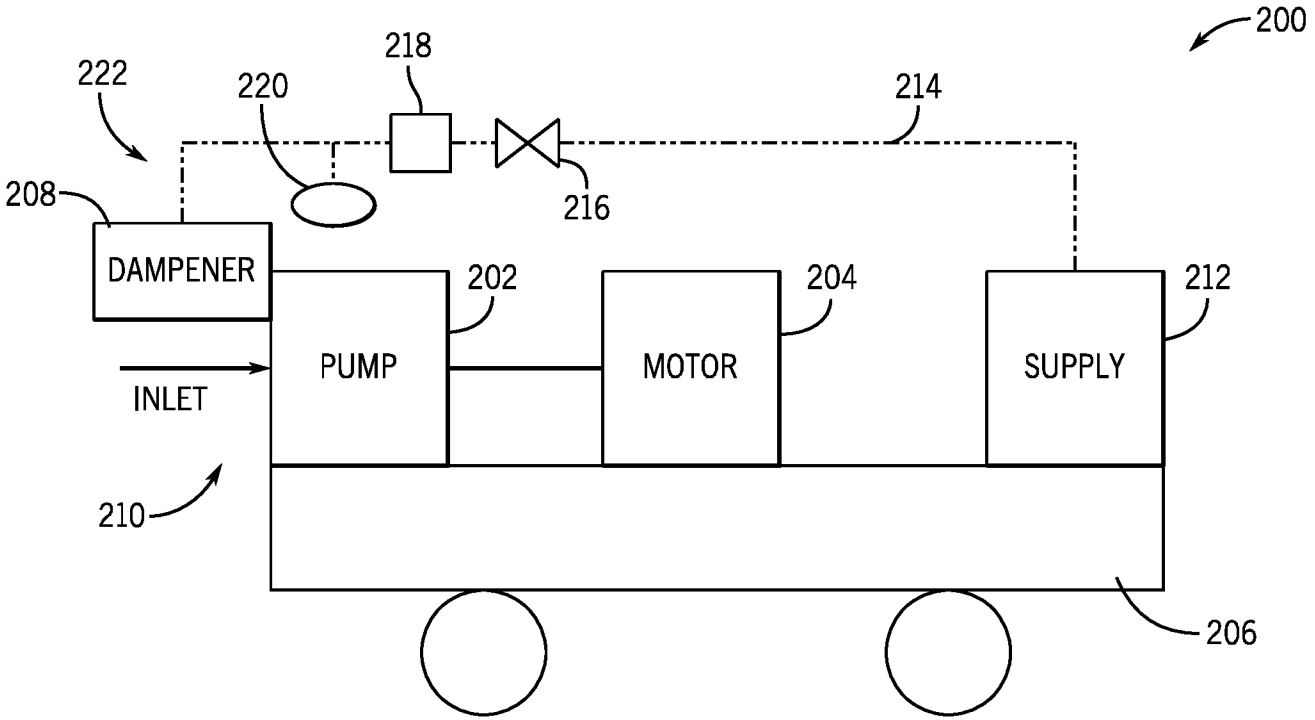
FIG. 2 is a block diagram of an embodiment of a pumping configuration for a fracturing operation, in accordance with embodiments of the present disclosure.

FIG. 2 is a schematic diagram of an embodiment of a piping configuration 200 that may be utilized with embodiments of the present disclosure. In the illustrated embodiment, a pump 202 and a motor 204 are arranged on a trailer 206, as described above. It should be appreciated that the trailer 205 is provided for convenience and by way of example only, and that in various embodiments the pump 202 and the motor 204 may be arranged on a skid, truck bed, or the like. Moreover, it should be appreciated that the motor 204 may be utilized to power more than one pump 202. The illustrated suction stabilizer/dampener 208 is arranged at a suction side 210 of the pump 202. Typically, the suction stabilizer/dampener 208 remains charged by a compressed gas supply, such as air or nitrogen, that may utilize bottles or containers arranged proximate the trailer. Embodiments of the present disclosure utilize an available source, for example a supply 212 (e.g., an air supply) associated with the trailer 206, in order to provide the compressed gas to the suction stabilizer/dampener 208. In the illustrated embodiment, a hose 214, or other flow path (e.g., hard piping, flexible tubing, combinations thereof, etc.) is arranged between the supply 212 and the suction stabilizer/dampener 208. The illustrated hose 214 includes a valve 216, a regulator 218, and a pressure gauge 220. It should be appreciated that the valve 216 may be any kind of valve, such as a gate valve, globe valve, ball valve, needle valve, or any other reasonable valve. A connection 222 may be formed between the supply 212 and the suction stabilizer/dampener 208. The valve 216 may be opened and the regulator 218 may be moved to an open position and adjusted to a set pressure, for example approximately 90 psi. The pressure gauge 220 may be evaluated and once it reaches a desired pressure, the regulator 218 may be closed and the valve 216 may also be closed. Thereafter, the pressure gauge 220 may be monitored to determine whether additional compressed gas is needed.

It should be appreciated that embodiments may include an automatic or manual operation, or a combination of the two. For example, the pressure gauge 220 may be utilized to control one or more aspects, such as the regulator 218. Further, upon reaching a set pressure, a signal may be transmitted to the valve 216 to move to a closed position. Thereafter, upon detection of a pressure below a threshold, an alert may be transmitted and/or the supply 212 may be engaged to provide additional pressurized gas. In this manner, operators may reduce their maintenance operations, which may improve well site operations. Moreover, the benefits provided above may also be realized by the system by reducing the likelihood of under pressure in the suction stabilizer/dampener 208, thereby reducing potential damage to the system.

Figure 3:
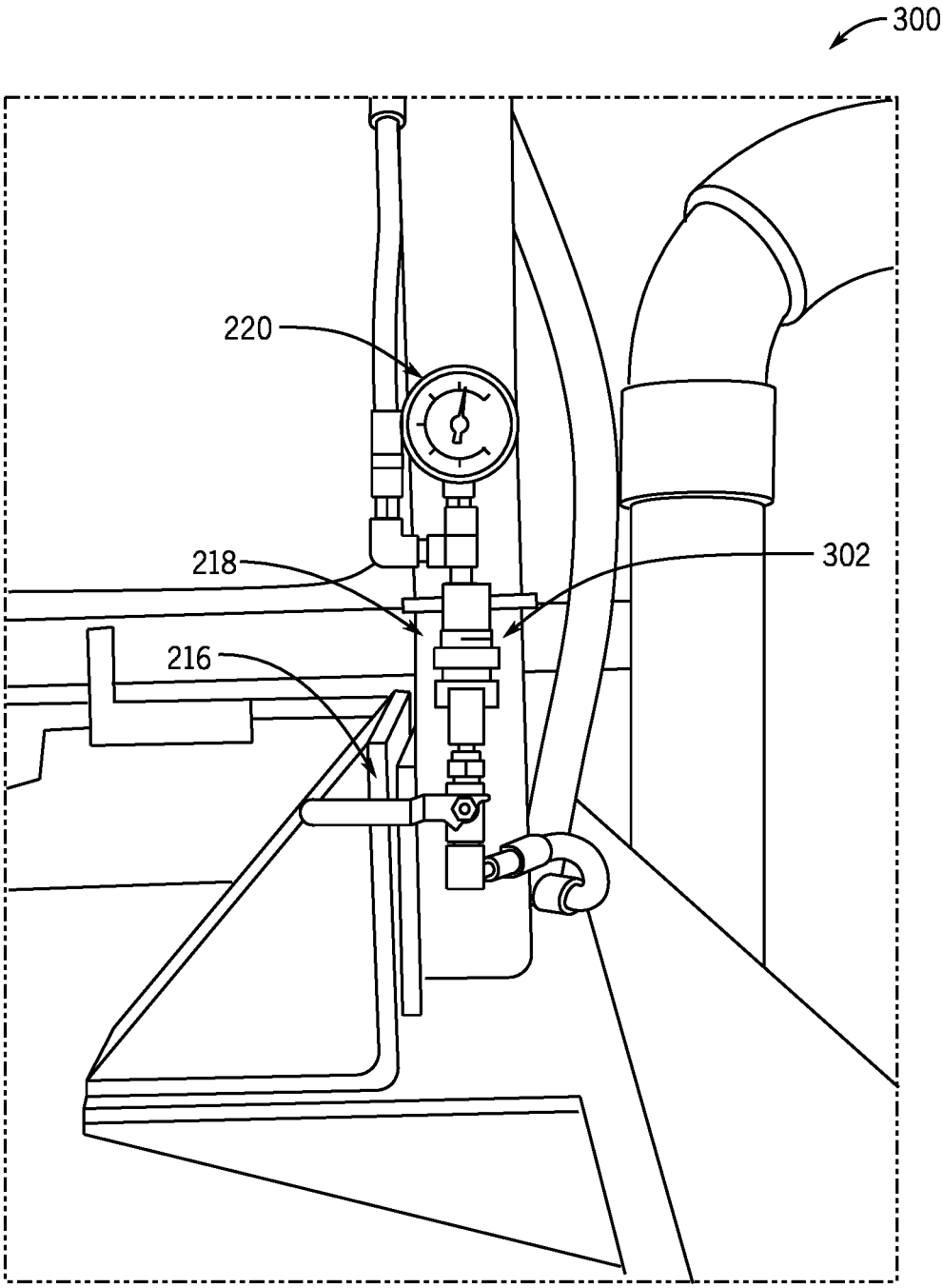
FIG. 3 is a schematic view of an embodiment of a piping configuration, in accordance with embodiments of the present disclosure.

FIG. 3 is a perspective view of an embodiment of a piping configuration 300 including the pressure gauge 220, the regulator 218, and the valve 216, which is a ball valve in the illustrated embodiment. In this example, the regulator 218 and the valve 216 are arranged in series such that the regulator 218 is downstream of the valve 216 relative to a flow direction. Accordingly, closing the valve 216 may block or otherwise restrict flow to the regulator 218. In this example, the regulator 218 may include a screw mechanism 302 that enables opening and closing of the regulator 218, as noted above. It should be appreciated that, in various embodiments, one or more features shown in FIG. 3 may be integrated. For example, the pressure gauge 220 may be integrated into the regulator 218. Furthermore, while manually operated components are illustrated in FIG. 3, it should be appreciated that automated components may also be utilized in embodiments of the present disclosure. As an example, the valve 216 may be an actuated valve that receives a signal from the gauge 220, which may be a sensor, to open and/or close the valve 216. Moreover, the gauge 220 (e.g., sensor) may also transmit a signal to the supply or compressor described above to recharge or refill the supply, thereby reducing operator interaction with the system.

It should be appreciated that embodiments may be directed toward one or more methods or a series of steps in order to charge the suction stabilizer/dampener 208. As an example, the system may be cleared of pressure before operations begin. Thereafter a compressor or other equipment associated with the supply 212 may be activated in order to fill the supply 212 with gas, such as compressed air or any other gas available at the site. Thereafter, the valve 216 may be open and the regulator 218 may be moved to an open position that permits air to flow toward the suction stabilizer/dampener 208. As the regulator 218 is open, the it may be set or otherwise adjusted to a particularly selected pressure and then locked into place once the gauge 220 reads the desired temperature. The valve 216 may then be closed and the gauge 220 and/or sensors may be utilized to monitor pressure within the suction stabilizer/dampener 208.

Figure 4:
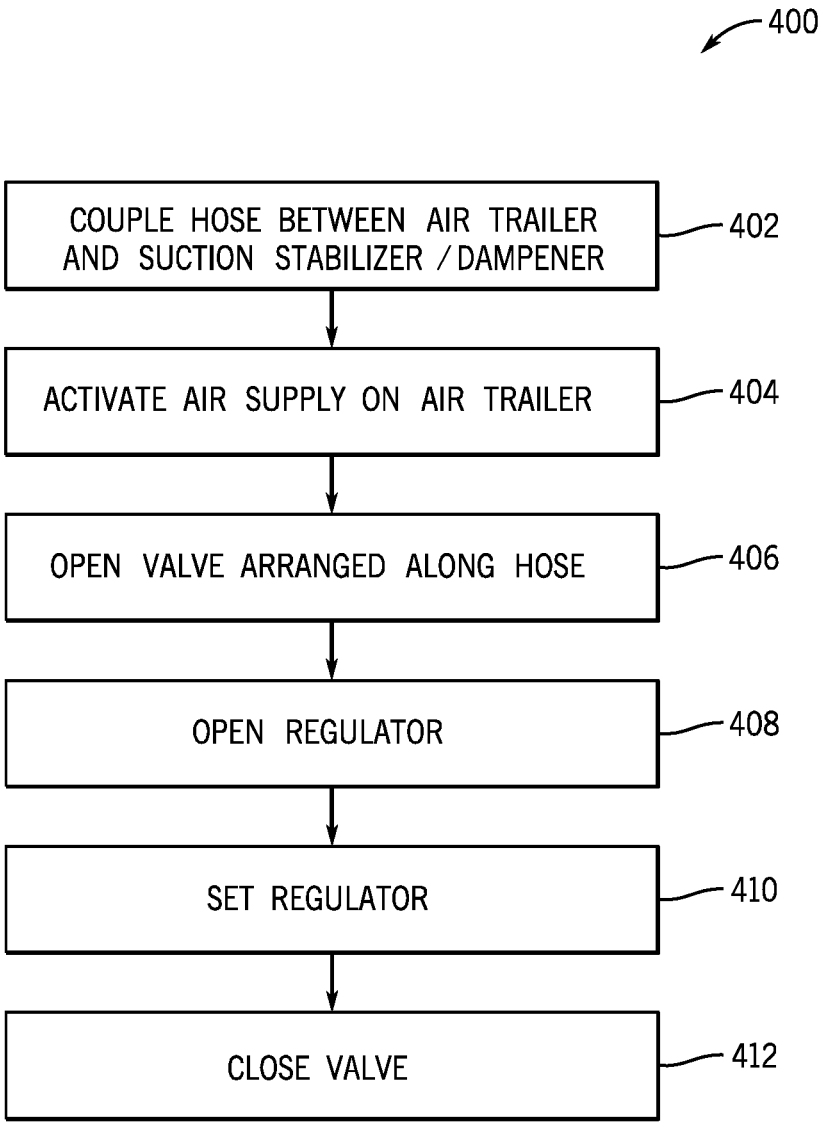
FIG. 4 is a flow chart of an embodiment of a method for charging a suction stabilizer/dampener, in accordance with embodiments of the present disclosure.

FIG. 4 is a flow chart of a method 400 for providing pressurized gases, such as air, to the suction stabilizer/dampener. It should be appreciated that the method may include more or fewer steps and, moreover, that the steps may be performed in a different order or in parallel unless otherwise specifically stated. This example begins with coupling a hose between an air supply, such as an air supply on a trailer, and a suction stabilizer/dampener 402. It should be appreciated that the air supply may be a readily available supply or may be a supply arranged on site for the pumping process. The air supply may be activated, for example, by engaging a compressor 404. A valve along the hose may be opened and a regulator may be opened 406. As pressure reaches a desired level, the regulator may be set 410 and the valve is closed 412. Thereafter, an operator may monitor pressure to determine whether additional air is needed. As noted above, in various embodiments one or more steps may be automated and/or regulated by a pressure gauge, actuator, or the like.

Figure 5:
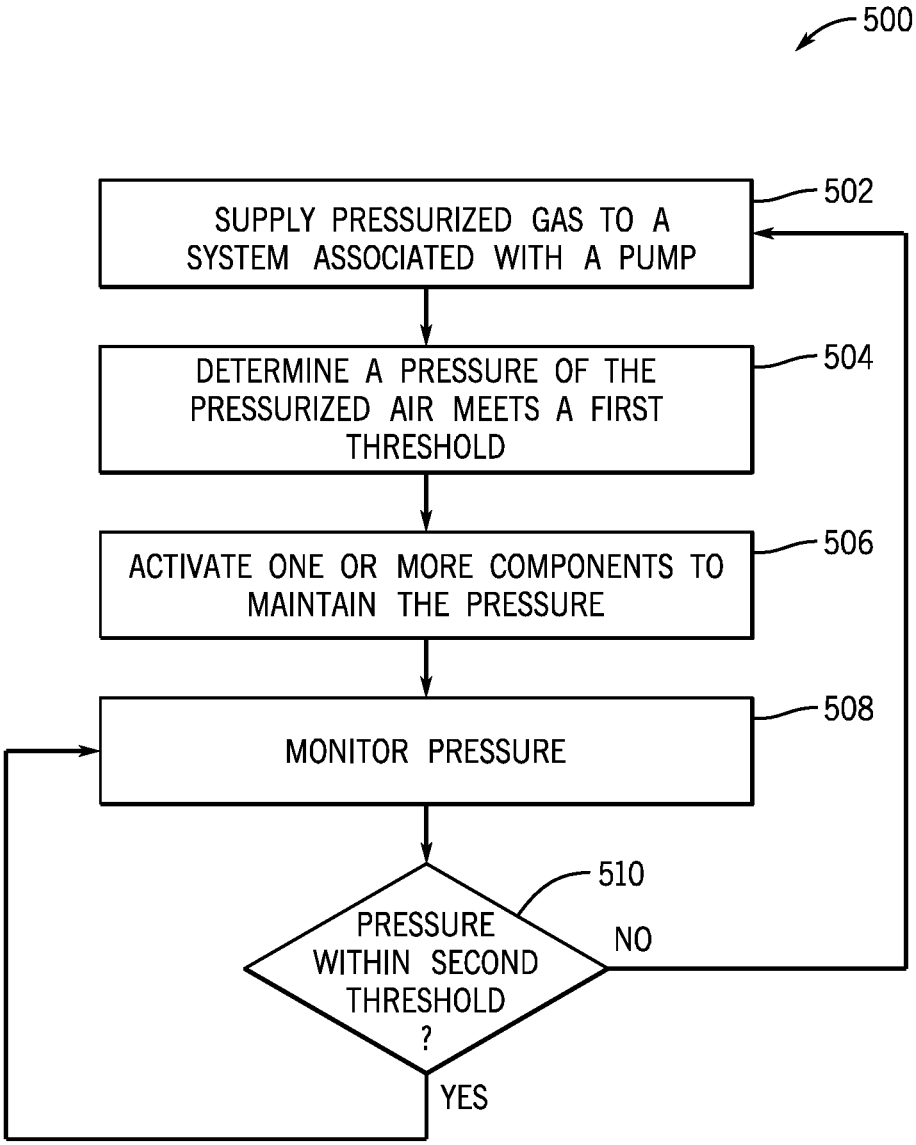
FIG. 5 is a flow chart of an embodiment of a method for charging a suction stabilizer/dampener, in accordance with embodiments of the present disclosure.

FIG. 5 is a flow chart of an embodiment of a method 500 for providing pressurized gases, such as air, to the suction stabilizer/dampener. In this example, pressurized gas is provided to a system associated with a pump 502. As noted above, the system may include one or more components of the present embodiments, including the suction stabilizer/dampener and/or the supply, among other components. The pressure of the system may be evaluated against a threshold to determine the pressure meets or exceeds a first threshold 504. For example, the first threshold may be a recommended operational range for the system. One or more components may be activated to maintain pressure within the system 506, such as the regulator and/or the valve. The pressure may be monitored 508. For example, a sensor may be utilized to monitor pressure in the system. A determination may be made whether the pressure is within a second threshold, which may include a range above or below the first threshold or a desired operating parameter. If the pressure is within the second threshold, then monitoring continues. If it is not, then additional pressurized gas may be supplied to the system. As noted above, one or more steps may be automated and/or controlled by a controller, which may include a processor and memory that includes machine readable instructions that may be executed by the processor.

Figure 6:
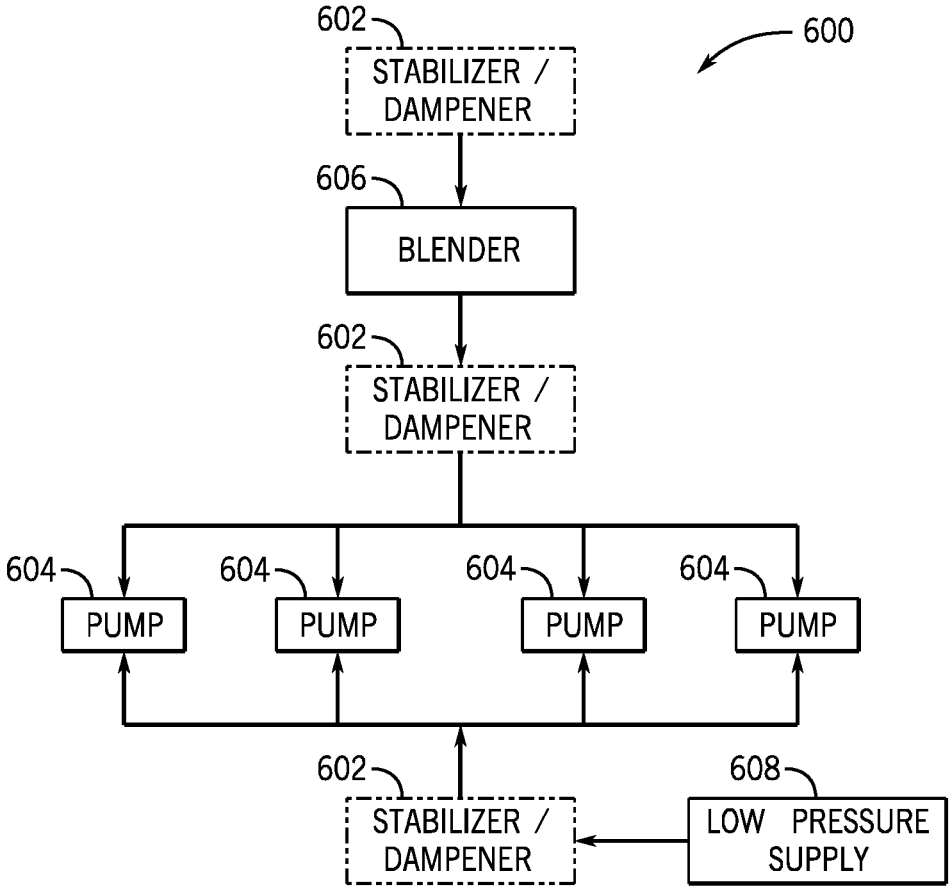
FIG. 6 is a schematic diagram of an embodiment of a pumping configuration, in accordance with embodiments of the present disclosure.

FIG. 6 is a schematic diagram on an embodiment of a pumping configuration 600 where individual stabilizer/dampeners for pumps have been replaced with a common stabilizer/dampener 602 that may be utilized with multiple pumps 604. In this example, the stabilizer/dampener 602 is arranged upstream of the pumps 604, but it should be appreciated that the stabilizer/dampener 602 may be positioned at various different locations. By way of example only, FIG. 6 illustrates the stabilizer/dampener 602 positioned upstream of a blender 606 and/or downstream of the blender 606. As noted above, different configurations may include replacement of individual pump suction dampeners/stabilizers with one single unit placed prior to the pumps. This could be on the suction side of the blender, the discharge side of the blender, on a supply missile or another location within the system. Additionally, multiple units that serve two or more pumps may be deployed. Accordingly, while the configuration illustrating the stabilizer/dampener 602 being utilized with four pumps 604, it should be appreciated that more or fewer pumps may be supported with the single stabilizer/dampener 602. Furthermore, as shown in the configuration of FIG. 6, the stabilizer/dampener 602 may also be arranged downstream of a low pressure supply 608, for example, such as a supply associated with a missile. Furthermore, it should be appreciated that multiple stabilizers/dampeners 602 may be incorporated into the system.

The present disclosure described herein, therefore, is well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure disclosed herein and the scope of the appended claims.

We claim:

1. A hydraulic fracturing system, comprising:
- an electric pump having an inlet to receive an inlet fluid supply;
- a suction stabilizer/dampener fluidly coupled to a suction end of the pump;
- a compressed gas supply;
- a first flow path extending between at least the compressed gas supply and the suction stabilizer/dampener;
- one or more pressure regulation devices associated with the first flow path; and
- a low pressure fluid supply upstream of the suction stabilizer/dampener, wherein a second flow path extends between the low pressure fluid supply and the suction stabilizer/dampener.

2. The hydraulic fracturing system of claim 1, wherein the one or more pressure regulation devices include at least one or more of a regulator and a valve.

3. The hydraulic fracturing system of claim 2, wherein the valve is at least one of a manual valve and an actuated valve.

4. The hydraulic fracturing system of claim 1, further comprising:
- a sensor associated with the first flow path, wherein data acquired from the sensor is used to control operation of the one or more pressure regulation devices.

5. The hydraulic fracturing system of claim 1, wherein the one or more pressure regulation devices is a regulator configured to be at a set pressure corresponding to an operating pressure for the suction stabilizer/dampener.

6. The hydraulic fracturing system of claim 1, wherein both the compressed gas supply and the electric pump are arranged on a common support structure.

7. The hydraulic fracturing system of claim 1, wherein the compressed gas supply is on a different support structure than the electric pump.

8. The hydraulic fracturing system of claim 1, further comprising:
- a second electric pump fluidly coupled to the suction stabilizer/dampener.

9. A system for hydraulic fracturing, comprising:
- a plurality of electric fracturing pumps;
- a suction stabilizer/dampener fluidly coupled to each respective suction end of each electric pump of the plurality of electric fracturing pumps;
- a compressed gas supply;
- a first flow path extending between at least the compressed gas supply and the suction stabilizer/dampener;
- a blender positioned upstream of the suction stabilizer/dampener, wherein a second flow path extends between the blender and the suction stabilizer/dampener, and
- a pressure regulation system associated with the first flow path, comprising:
  - a regulator;
  - a valve; and
  - one or more sensors.

10. The system for hydraulic fracturing of claim 9, further comprising:
- a low pressure fluid supply upstream of the suction stabilizer/dampener, wherein a third flow path extends between the low pressure fluid supply and the suction stabilizer/dampener.

11. The system for hydraulic fracturing of claim 9, wherein the valve is one of a manual valve or a remotely controlled valve.

12. The system for hydraulic fracturing of claim 9, wherein the regulator is a pressure regulator having a controllable set point.

13. The system for hydraulic fracturing of claim 9, further comprising:
- one or more electric motors to drive the plurality of electric pumps.

14. The system for hydraulic fracturing of claim 9, wherein the suction stabilizer/dampener is positioned on a first support structure and at least one electric pump of the plurality of electric pumps is positioned on a separate second support structure.

15. The system for hydraulic fracturing of claim 9, wherein data acquired by the one or more sensors is used to adjust a position of at least one of the regulator or the valve.

16. A method, comprising:
- supplying a pressurized gas to a suction stabilizer/dampener associated with an electric pump;
- determining an operating pressure for the suction stabilizer/dampener meets or exceeds a threshold;
- setting one or more pressure control devices associated with the suction stabilizer/dampener to maintain the operating pressure at or above the threshold, wherein the operating pressure is determined, at least in part, by a sensor associated with the one or more pressure control devices;
- determining the operating pressure has dropped below the threshold; and
- performing one or more remedial operations, wherein the one or more remedial operations are automatic operations triggered by data acquired by the sensor.

17. The method of claim 16, wherein the one or more remedial operations includes at least one of:
- supplying additional pressurized gas to the suction stabilizer/dampener; or
- modifying one or more properties of the one or more pressure control devices.

* * * * *